United States Patent [19]

Keller

[11] 4,412,392

[45] Nov. 1, 1983

[54] GRAIN DRYING AND STORAGE STRUCTURE

[76] Inventor: Richard L. Keller, Tenney, Minn. 56582

[21] Appl. No.: 385,667

[22] Filed: Jun. 7, 1982

[51] Int. Cl.[3] ..... F26B 11/00

[52] U.S. Cl. ..... 34/233; 34/225

[58] Field of Search ..... 34/233, 225; 98/55; 52/192, 245, 302, 303, 801

[56] References Cited

U.S. PATENT DOCUMENTS

| | | | |
|---|---|---|---|
| 255,608 | 3/1882 | Eaton . | |
| 1,147,207 | 7/1915 | Brumbaugh . | |
| 1,564,782 | 12/1925 | Harris | 34/225 |
| 2,641,449 | 6/1953 | Antony | 52/303 |
| 3,287,886 | 11/1966 | Tiberi . | |
| 3,686,802 | 8/1972 | Sietmann . | |
| 4,256,029 | 3/1981 | Steffen . | |
| 4,319,411 | 3/1982 | Steffen | 34/233 |

*Primary Examiner*—Larry I. Schwartz
*Assistant Examiner*—David W. Westphal
*Attorney, Agent, or Firm*—Dorsey & Whitney; William C. Babcock, Esq.

[57] ABSTRACT

An improvement to a grain drying and storage structure which reduces moisture condensation on the inside of the walls of the grain drying structure by forcing heated air out through a peripheral opening at the top of the wall of the drying structure into a space between the wall and an external shell, thus heating the wall, and which allows moisture that condenses under the roof of the grain drying structure to drain to the outside of the grain drying structure so that it does not drain down onto the drying grain.

9 Claims, 3 Drawing Figures

GRAIN DRYING AND STORAGE STRUCTURE

BACKGROUND OF THE INVENTION

1. Field of the Invention

This invention relates generally to an improvement in a drying and storage structure. More particularly, this invention relates to an improved drying and storage structure for food grains of the type wherein heated air is forced up through the grain to remove moisture from the grain.

2. Description of the Prior Art

Conventional grain drying and storage structures usually include vertical walls having an inclined or conical roof mounted thereon. The drying structures generally have a perforated false floor or other means for supporting the grain. Heated air is forced into a chamber located under the perforated floor and thence up through the perforated floor and through the grain to dry the grain. The moisture-laden air which has passed through the grain is generally discharged through a roof opening. The drying process results in condensation accumulating under the roof of the drying structure. This moisture may drip back down on to the drying grain, or it drains down the interior of the roof to the interior of the walls of the drying structure. Condensation also occurs on the inside of the walls of the storage structure, as the walls are at the temperature of the outside air, which is lower than the temperature of the drying air stream within the structure. Such dripping and wall condensation wet the grain by contact, causing non-uniform drying and curing and possibly sprouting or other spoilage. Drying time is also increased.

In the prior art, drying and storage structures have generally utilized an exhaust port at the apex of the roof to vent warm moisture-laden air. The problem of removal of moisture condensation on the interior of roof or walls is usually not addressed. One exception to this is U.S. Pat. No. 3,686,802, which shows an auxiliary roof structure suspended below the roof to catch moisture that drips from the lower portion of the roof, and to carry it to the outside of the drying structure. As far as is known, nothing in the prior art has addressed the problem of interior wall condensation.

SUMMARY OF THE INVENTION

The present invention provides a shell, suspended exterior to and parallel to the wall of a grain drying structure and spaced from the wall. The shell extends down from the lower edge of the roof of the grain drying structure, which is raised above, extends outwardly beyond and overhangs the wall. The shell extends downward from the roof to cover at least fifty percent of the distance between the overhanging lower portion of the roof and the perforated floor of the drying structure.

As will be seen, the invention provides an inexpensive way of alleviating the condensation problem in a grain drying and storage structure. This aids in reducing the possibility of sprouting and spoilage of grain which frequently is caused by exposure to condensation, and it results in an increased efficiency in the drying of grain. Fuel costs are reduced because grain does not have to be dried twice. With the condensation problem reduced, a higher air temperature can be used, allowing faster drying of the grain. In addition, the raised roof allows for a relatively large cross section in the ventilation path, and consequently, a greater flow of air out of the drying structure, again shortening the time needed to dry the grain.

The primary objective of the invention is to provide a simple and inexpensive way to reduce condensation on the inside of the wall of a grain drying structure and to permit moisture that condenses under the roof of a grain drying structure to drain outside of the wall of the drying structure so that it does not drain on to the drying grain.

A further objective is to provide a roof structure that is raised above the wall of a grain drying structure and that extends outwardly beyond and overhangs the wall.

A further objective is to provide a cylindrical shell exterior to the wall of a grain drying structure and extending downward from the roof to cover at least fifty percent of the distance between the roof and the perforated floor of the drying structure.

A further objective is to provide a cylindrical shell structure of the type proposed that is composed of a plurality of rectangular metal panels having a sectioned, channel-like cross section.

A further objective is to provide a way of utilizing heated air that would otherwise be vented directly to the atmosphere to reduce interior condensation.

These and other objectives of the invention will become apparent from a study of the following description of the preferred embodiment and the following figures.

DESCRIPTION OF THE PREFERRED EMBODIMENTS

Figure 1:
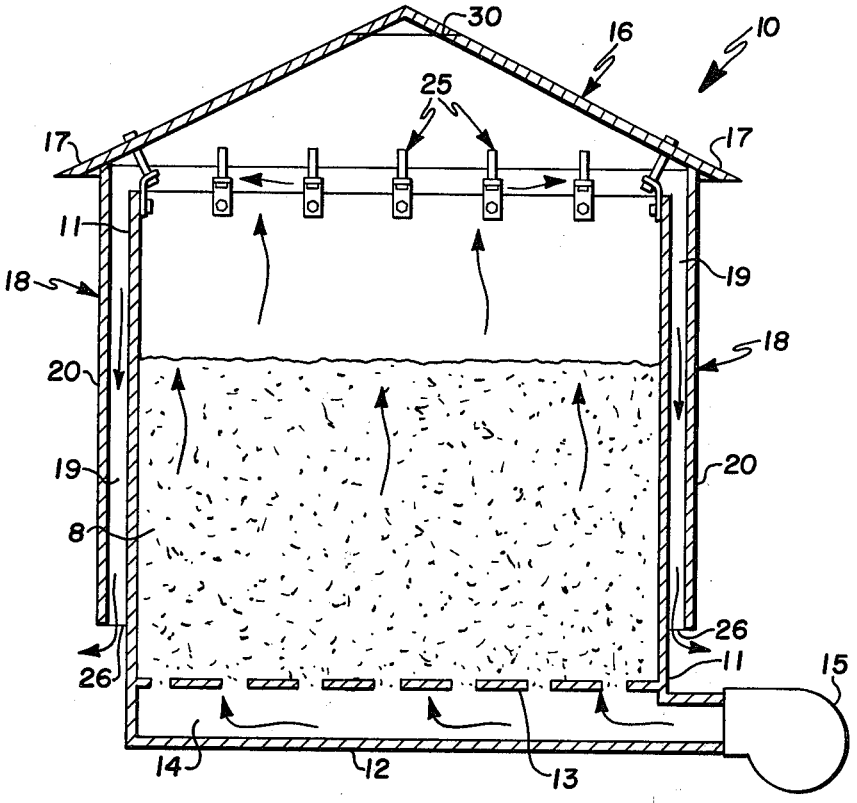
FIG. 1 is a vertical cross section of a grain drying structure constructed in accordance with the present invention.
Figure 3:
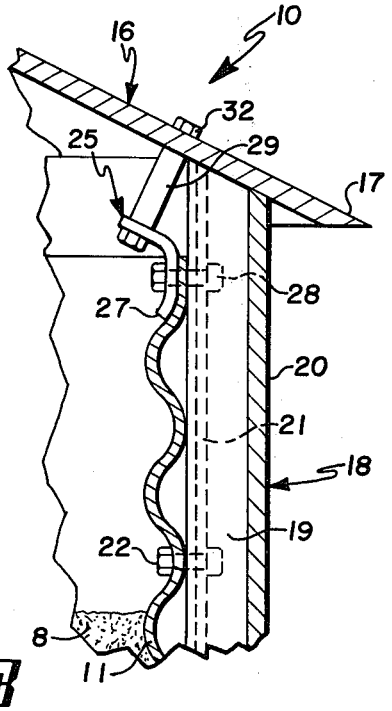
FIG. 3 is an enlarged detail in vertical cross section of the connection between the wall, the roof and the exterior shell, taken along the line 3—3 of FIG. 2.

In FIG. 1 grain drying structure 10 has a cylindrical wall 11, a floor 12, a perforated false floor 13 spaced above the floor 12 to form a chamber 14, and a heater and blower 15 to force heated air into the chamber 14 and up through the grain 8. The structure 10 is usually covered with a roof structure 16 having an apex access opening 30; it may also have additional access openings (not shown) in the roof 16 and/or wall 11. This is a conventional configuration for a grain drying and storage bin. Referring now also to FIG. 3, in accordance with the present invention, a conical roof structure 16 is attached to the wall 11 by brackets 25 at spaced intervals around the top of the wall 11 so that the roof structure 16 with its access opening 30 is raised above the wall 11. Spacing the roof 16 an equal distance above the top of the wall 11 at all points around the top of the wall 11 forms a peripheral opening of substantially uniform height. The lower portion 17 of the roof structure 16 extends outwardly beyond the brackets 25 and overhangs the wall 11 by several inches.

The structure of a bracket 25 is best seen in FIG. 3. A bracket base 27 is attached to the inside of the top of the wall 11 by suitable fastener means, such as the bolt 28. The roof 16 is elevated to the desired height by means of a spacer 29 of appropriate length (two inches in the preferred embodiment) threaded on a bolt 32 which connects between the roof 16 and the top of the bracket base 27. When a roof 16 is made of sectioned panels (not shown) double brackets having two substantially parallel bolt-spacer combinations are used to hold adjacent panel edges, with single brackets used in the center of each roof panel.

A cylindrical shell structure 18 is attached to the wall 11 so that the shell structure 18 forms an exterior layer substantially parallel to and outside of the wall 11 around the entire circumference of the wall. The shell 18 extends from the underside of the lower portion 17 of the roof 16 to a point somewhat above the level of the perforated floor 13 of the drying structure, creating a space 19 between the cylindrical shell structure 18 and the wall 11. Hot moist air that has passed through the grain will be forced out through the circumferential opening between the top of the wall 11 and the underside of the roof 16 and then downward into the space 19, eventually venting to the outside at an exit opening 26 which extends around where the shell structure ends, as illustrated in FIG. 1.

Figure 2:
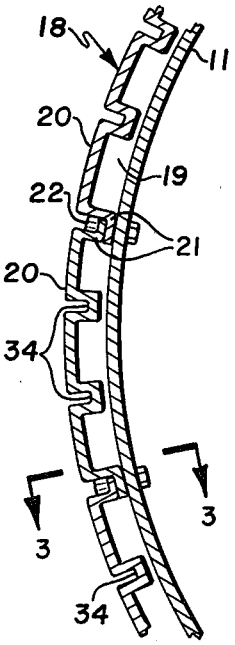
FIG. 2 is an enlarged horizontal cross section of a portion of the wall of the grain drying structure and the exterior shell.

In FIG. 2 the preferred embodiment of the cylindrical shell structure 18 is shown. It consists of adjacent, parallel, elongated rectangular panels 20, each having a sectioned, channel-like cross section with parallel longitudinal stepped edges 21 that are overlapped and held together and to the wall 11 by screws or other suitable fastener means 22. Such panels 20 are made of galvanized steel and are commonly available with two longitudinal indentations 34 between the edges 21, dividing each panel 20 into three longitudinal sections. Because the panels 20 are somewhat flexible, they can bend to follow the contour of the wall 11, with the edges 21 and the indentations 34 all being adjacent to the wall 11. In the typical situation of a drying structure having walls made of corrugated metal, the longitudinal edges 21 of the panels 20 are fastened to the outermost undulations of the corrugations (see FIG. 3) by fastener means 22 placed at appropiate intervals. When the longitudinal sections of panels 20 are sufficiently narrow relative to the circumference of the storage structure 10, their flat webs provide an approximation to the contour of the wall 11. The upper edge of the panels 20 can be cut at an angle matching the slope of the lower portion 17 of the roof 16 so that a more airtight fit is made between the two. The panels 20 bear a significant portion of the weight of the roof 16.

In the preferred embodiment of the invention certain relative dimensions are significant. First, it is clear that the venting path should be coordinated with the air flow capacity of the heater and blower 15 over the range of loads it will face. In particular, the circumferential opening between the top of the wall 11 and the underside of the roof 16 and the cross-section of the flow path of the space 19 between the wall 11 and the shell structure 18 should be sufficiently large that adequate drying air flow can be maintained. On the other hand, it is clear that the warming effect on the wall 11 is dissipated somewhat when the cross section of the flow path is too large. In view of these considerations, it has been found preferable (for a cylindrical drying structure with a wall eighteen feet high and an approximately equal diameter) to raise the lower portion 17 of the roof 16 approximately two inches above the top of the wall 11 and to have the shell structure 18 at a distance of approximately two inches from the wall 11. It is anticipated that this two inch dimension could be varied between one inch and five inches with approximately the same advantages of the invention being maintained. It has also been found that the panels 20 need not extend all the way down to the level of the perforated floor 13. As the heated air is warmer and contains less moisture in the area just above the perforated floor wall, condensation is less of a problem in that area. In practice, it has been found that panels 20 which extend 80% of the distance between the underside of the roof 16 and the level of the perforated floor 13 are preferred. Substantial benefits in terms of reduced condensation are achieved once the panels 20 extend at least 50% of this distance.

During a drying operation when the heater and blower 15 are forcing heated air up through the grain 8, the invention functions as follows. The heated, moisture-laden air escapes from the top of the grain 8, into the volume under the roof 16. Some condensation will occur on the underside of the roof 16, which will tend to flow or trickle downward toward the lower portion 17 of the roof 16. Due to the action of the heater and blower 15, the pressure under the roof 16 will be slightly higher than atmospheric and the heated, moisturized air will seek to escape the volume under the roof 16. Assuming that access opening 30 is closed, the favored escape path will be through the circumferential opening between the top of the wall 11 and the underside of the roof 16 and, thence, downward between the exterior of the wall 11 and the interior of the shell structure 18. This will occur even with access opening 30 open, if air pressure is high enough. Because the air vented in this manner is heated, it keeps the wall 11 warmer than if it were exposed to ambient temperatures. This reduces condensation on the inside of the wall 11. If any condensation occurs on the inside of the shell structure 18, it is not in contact with any grain and it runs harmlessly downward and drops off the lower edge of the shell structure 18.

Due to the venting of heated, moisture-laden air along the above-described path condensation will occur on the underside of the roof 16. This condensation will run outward and downward along the underside of the roof 16, so that it will drop into the space 19 or run down the interior of the shell structure 18 and, thus, escape to the outside.

Once the grain (or other material) has been dried, it may be removed from the drying structure 10 for storage elsewhere or left in the drying structure 10 for storage there.

It is evident that there can be minor changes from the preferred embodiment without departing from the spirit and scope of the invention. The shell structure could be made of materials other than metal, such as plastic or fiberglass, and could be constructed from other than rectangular panels. It could be attached to the wall structure by means independent of the means for attaching two panels together, or it might be attached to the roof structure. It is also evident that the invention is applicable to a wide variety of grain storage structures which are not cylindrical, although cylindrical structures are believed to be most common and are used as the basis of description herein.

Having thus described the invention, what is claimed as new and desired to be protected by Letters Patent is:

1. In a drying structure of the type having an exterior wall with an upper edge, an inclined roof structure with a lower portion extending outwardly beyond and overhanging the upper edge of the exterior wall, a perforated false floor on which a material to be dried is placed and means for driving heated air from under the perforated false floor up into and through the material to be dried, the improvement comprising:

(a) means for supporting the roof structure so that its lower portion is spaced equidistant above the upper edge of the wall;

(b) a shell structure for surrounding a portion of the wall, said shell structure having an upper edge and a lower edge and extending substantially continuously around the exterior of the wall; and (c) means for holding the shell structure exterior of the wall so that the shell is in a spaced relationship with the wall, the upper edge of the shell being in close proximity to the overhanging lower portion of the roof structure where it extends outwardly beyond the upper edge of the wall, and the lower edge of the shell extending at least fifty percent of the distance between the overhanging lower portion of the roof structure and the perforated floor of the drying structure, whereby the heated air, after passing upwardly through the material to be dried, is directed through the space defined between the upper edge of the wall and the lower portion of the roof structure and thereafter passes downwardly through the space defined between the shell structure and wall so as to protect the wall adjacent the shell from ambient temperature and to also prevent condensation from forming on the interior of the wall.

2. The improved drying structure of claim 1 wherein the shell structure is substantially parallel to the wall.

3. The improved drying structure of claim 1 wherein the shell structure is attached to and supported on the wall.

4. The improved drying structure of claim 1 wherein the shell structure is spaced between one inch and five inches from the exterior wall.

5. The improved drying structure of claim 1 wherein the distance between the lower portion of the roof structure and the upper edge of the exterior wall is between one inch and five inches.

6. The improved drying structure of claim 1 wherein the distance between the shell structure and the exterior wall is substantially equal to the distance between the lower portion of the roof structure and the upper edge of the exterior wall.

7. The improved drying structure of claim 1 wherein the lower edge of the shell structure extends at least eighty percent of the distance between the overhanging lower portion of the roof and the perforated floor.

8. The improved drying structure of claim 1 wherein the shell comprises:

a plurality of rectangular metal panels, each panel having its two long edges structured so that they are in a plane parallel with the plane of the panel but in a step relationship with the panel; and means for attaching the stepped edges of laterally adjacent panels to each other and to the wall of the drying structure so as to form an open air flow channel between each of said panels and the wall.

9. The improved drying structure of claim 8 wherein the drying structure has a cylindrical exterior wall and the rectangular metal panels are elongated and are divided by at least one longitudinal indentation into at least two longitudinal sections, the width of each longitudinal section being small relative to the circumference of the drying structure.

* * * * *